US007172489B1

(12) United States Patent
Flanagan

(10) Patent No.: US 7,172,489 B1
(45) Date of Patent: Feb. 6, 2007

(54) JAR OPENER

(76) Inventor: Michael P. Flanagan, 10 Filare, Irvine, CA (US) 92620

( * ) Notice: Subject to any disclaimer, the term of this patent is extended or adjusted under 35 U.S.C. 154(b) by 6 days.

(21) Appl. No.: 11/190,341

(22) Filed: Jul. 26, 2005

(51) Int. Cl.
*B67B 7/62* (2006.01)
*B67B 7/00* (2006.01)
*B67B 7/46* (2006.01)

(52) U.S. Cl. ..... 451/3.37; 81/3.45; 81/3.25; 81/3.31; 81/3.32; 81/3.39

(58) Field of Classification Search ..... 81/3.07–3.57; 29/426.5, 456, 426.1; 269/204, 218; 53/317, 53/331.5, 381.4; 74/458
See application file for complete search history.

(56) References Cited

U.S. PATENT DOCUMENTS 4,569,281 A * 2/1986 Woods ..... 100/103
6,148,692 A * 11/2000 Russell ..... 81/3.2
2005/0257646 A1* 11/2005 Yeager ..... 81/3.33
2006/0174728 A1* 8/2006 Flanagan ..... 81/3.32

* cited by examiner

*Primary Examiner*—Lee D. Wilson
*Assistant Examiner*—Bryan R. Muller
(74) *Attorney, Agent, or Firm*—James E. Brunton, Esq.

(57) ABSTRACT

A jar opening apparatus for opening a jar having a screw-on lid which comprises a base having a jar supporting surface, a generally vertically extending guide column connected to the base and a carriage assembly connected to the guide for movement relative to the guide between a first raised position and a second lowered position. The carriage assembly comprises a carriage; a lid engaging member connected to the carriage for engaging the screw-on lid when the carriage is in the second position, and rotating means for imparting rotation to the lid engaging member. The rotating means uniquely comprises a drive screw connected to the carriage and a cooperating driven tube connected to the lid engaging member. A novel operating mechanism is operably associated with the carriage for moving the carriage between the first and second positions.

20 Claims, 8 Drawing Sheets

2
2
20
56b
92a
88
76
33
72
38
30
91
50
32
78
52
92
79
42
76b
76a
91
52b
80
56
32a
46
36
26a
40
40a
L
26
76
J
76c
81
24
22

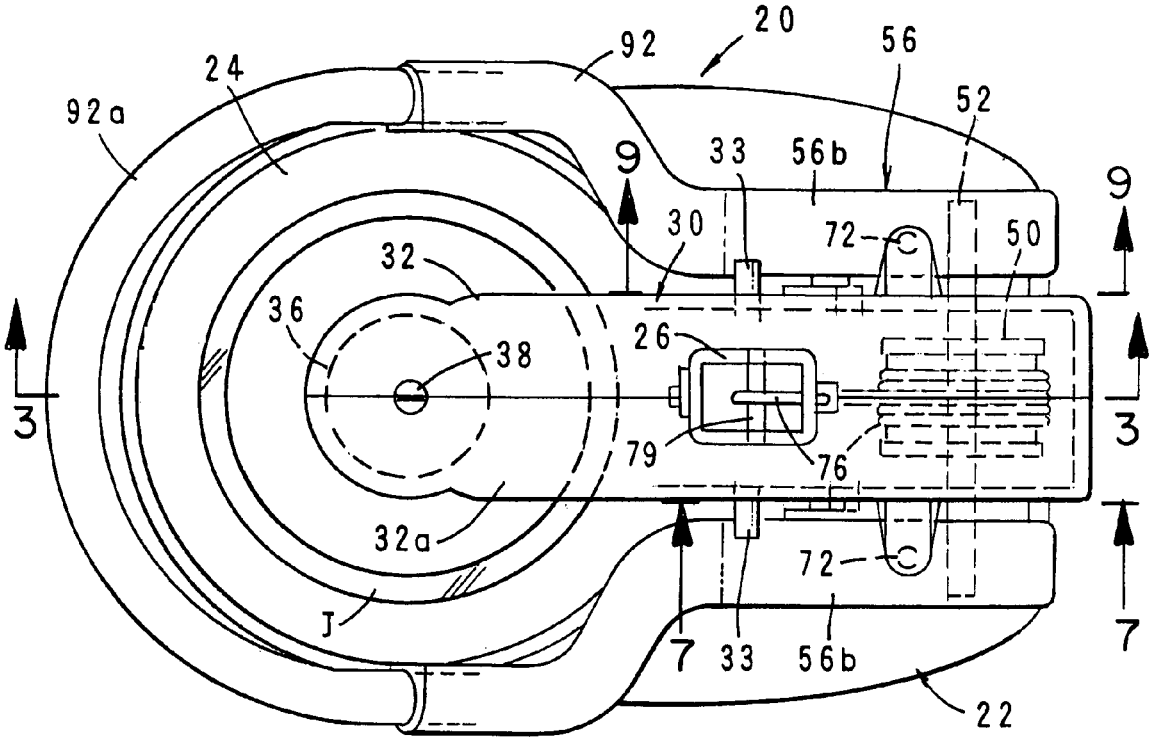
FIG. 2
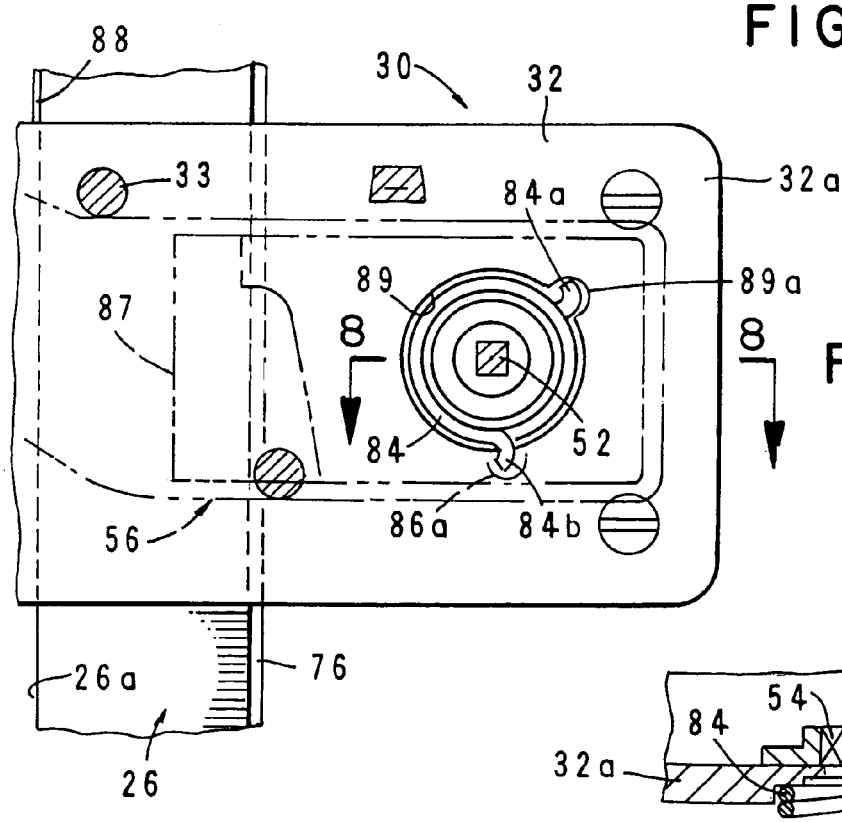
FIG. 7
FIG. 8
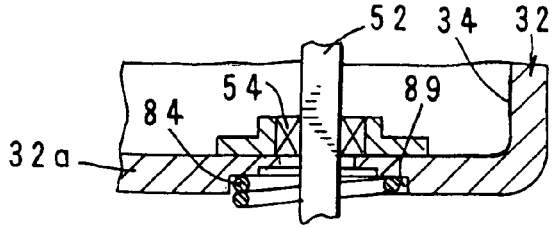

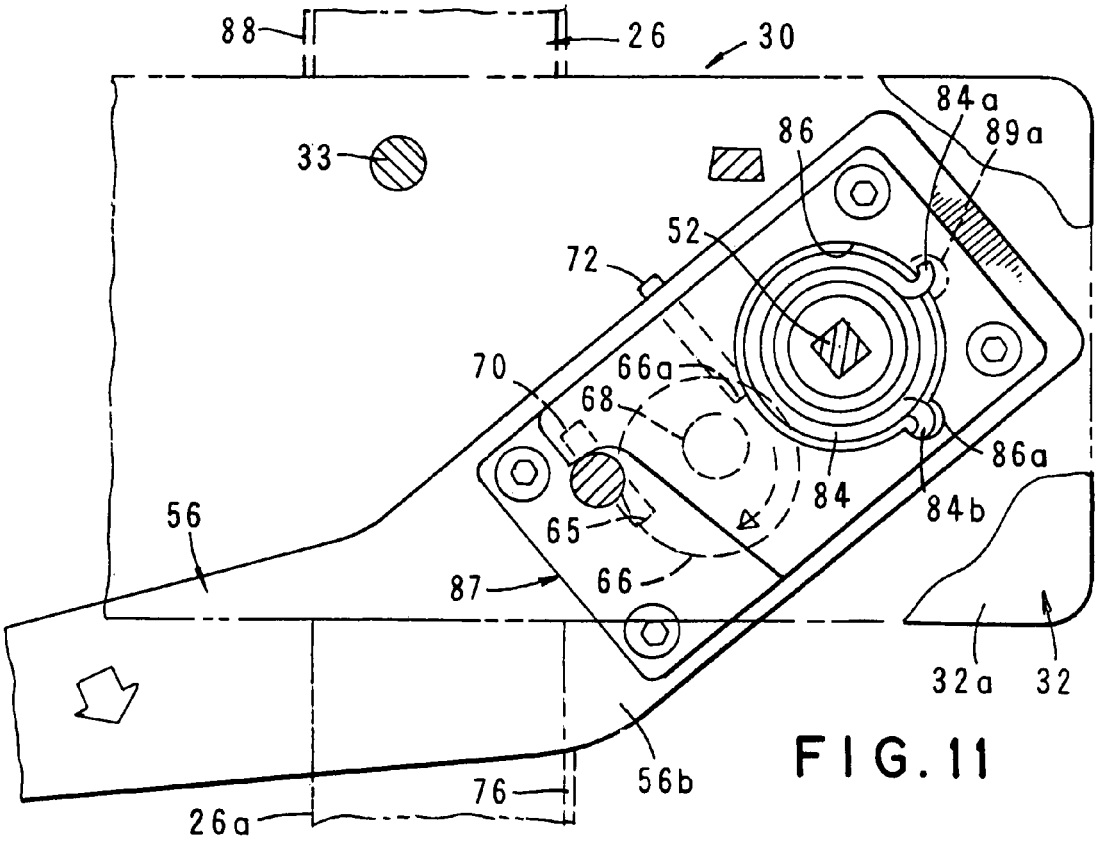
FIG. 11
FIG. 13
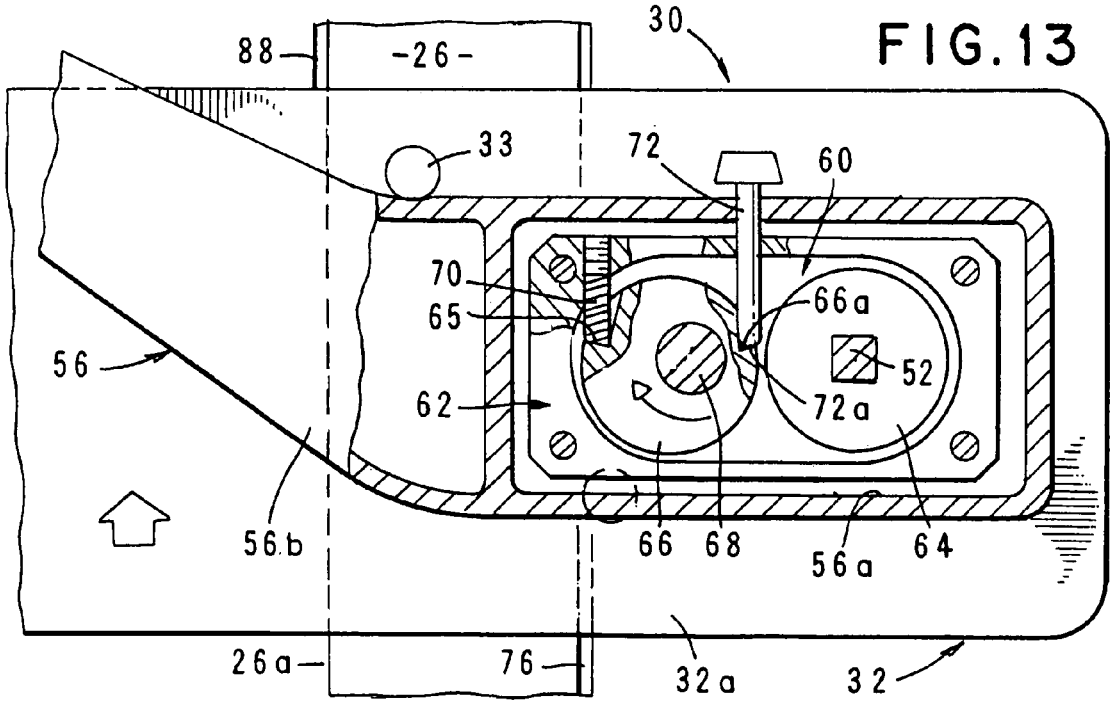

JAR OPENER

BACKGROUND OF THE INVENTION

1. Field of the Invention

The present invention relates generally to devices for opening sealed containers. More particularly the invention concerns a manually operated apparatus for removing screw-on lids from jars.

2. Description of the Prior Art

Jars and bottles, commonly made of glass have long been employed to contain and store various types of foods and materials. Typically, such containers are provided with screw-type closure lids, which attach to the jars by cooperating threads. In order to properly seal the container, the lid is generally tightly fitted to its associated jar often making it difficult to remove the lid from the container. Entrapment of small amounts of the contained material within the threads may also contribute to difficulty in loosening the jar lid as will corrosion of the lid with the passage of time. Even under the best of conditions, the very young, the elderly and persons with arthritis and like infirmities often find it extremely difficult to accomplish the task of removing the threaded lid from its associated container.

A wide variety of jar opening devices have been suggested in the past. For example, several container opening devices of the strap wrench type have previously designed and marketed. Generally these devices include a friction buckle arrangement along with an elongated handle for removing the lid. In other prior art under the counter type devices a cam lock principle is used such as "V" notch and cam-lock for gripping the jar lid. These devices generally require the user to hold the container in position while turning it. When the container is made of glass, breakage of the container is possible, resulting in the possibility of severe lacerations to the hand of the user.

A more sophisticated type of container opening device is described in U.S. Pat. No. 5,430,923 issued to Parent, et al. The Parent, et al device includes a mechanical drive for causing relative rotation to occur between the container cap and a cap engaging unit. The mechanical drive brings the cap unit into engagement with the cap and then slips to permit the cap to be unscrewed from the container. A control unit senses the torque created by the relative rotation between the cap and the cap engaging unit and when a drop in torque is sensed, the control unit causes the drive to move the cap and the cap engaging unit out of operable engagement.

U.S. Pat. No. 3,795,158 issued to Morita discloses a jar lid remover which comprises a jar base clamp that is adjustable into a clamping relationship with the base of the jar and a jar lid clamp that is adjustably positioned directly above the base clamp for vertical adjustment. The jar lid clamp is power driven in a manner such that the motorized application of lid unscrewing torque increases the extent of the clamping engagement of the clamp means on the lid so as to prevent torsional slipping during the jar lid unscrewing operation.

SUMMARY OF THE INVENTION

By way of summary, one form of the novel jar opening apparatus of the invention for opening a jar having a screw-on lid comprises a base having a jar supporting surface, a generally vertically extending guide column connected to the base and a carriage assembly connected to the guide for movement relative to the guide between a first raised position and a second lowered position. The carriage assembly uniquely comprises a carriage; a lid engaging assembly connected to the carriage for engaging the screw-on lid when the carriage is in the second position, the lid engaging assembly including a lid engaging member; and rotating means operably associated with the lid engaging member for imparting rotation thereto. The rotating means here comprises a helical drive screw connected to the carriage and a helical cooperating drive tube connected to the lid engaging member. Operating means are operably associated with the carriage with for moving the carriage between the first and second positions. This novel operating means of the invention comprises a drum carried by the carriage for rotation therewithin; an elongated cable connected to the guide and entrained around the drum; and a handle assembly connected to the carriage for movement between a first position and a second position, the handle assembly including drum driving means for controllably rotating the drum. The drum driving means uniquely comprises a housing carried by the handle assembly; a driveshaft connected to the drum; a driven wheel carried within the housing and connected to the driveshaft; and an eccentric driving wheel rotatably carried within the housing, the eccentric driving wheel being movable between a first position spaced-apart from the driven wheel and a second position in driving engagement with the driven wheel.

With the forgoing in mind, it is an object of the present invention to provide an easy to use, hand operated apparatus for effortlessly loosening the threaded lid of ajar or bottle.

Another object of the invention to provide a jar lid removing apparatus of the aforementioned character which is designed to accommodate jars of different sizes.

Another object of the invention is to provide a jar lid removing apparatus which can be easily and effortlessly operated by persons lacking hand and arm strength, such as the elderly and the infirm.

Another object of the invention to provide a jar lid removing apparatus of the character described in the preceding paragraphs which is inexpensive to manufacture, is dependable in use and requires minimum maintenance.

Another object of the invention is to provide a jar lid removing apparatus which has a pleasing appearance, can be easily cleaned and takes up to a minimum kitchen counter surface area.

These and other objects of the invention will become readily apparent from the discussion which follows.

BRIEF DESCRIPTION OF THE DRAWINGS

FIG. 2 is a view taken along lines 2—2 of FIG. 1.

FIG. 7 is a cross-sectional view taken along lines 7—7 of FIG. 2.

FIG. 8 is a cross-sectional view taken along lines 8—8 of FIG. 7.

FIG. 11 is a side elevational cross sectional view similar to FIG. 9, but showing the operating handle of the device in a lowered position.

FIG. 13 is a cross-sectional view taken along lines 13—13 of FIG. 12.

DESCRIPTION OF THE INVENTION

Figure 1:
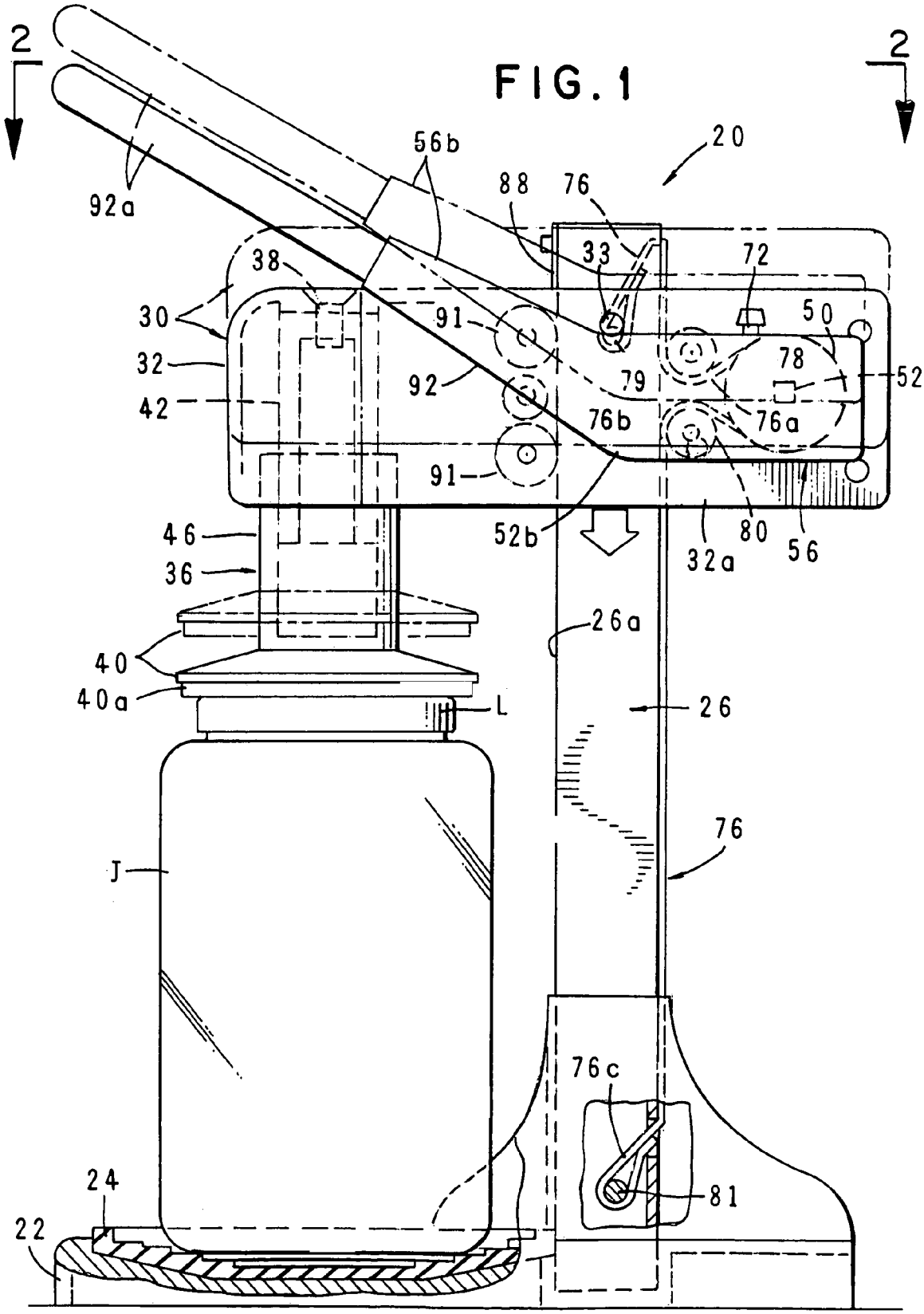
FIG. 1 is a side elevational view, partly broken away to show internal construction, of one form of the jar opening device of the present invention.
Figures 3, 4:
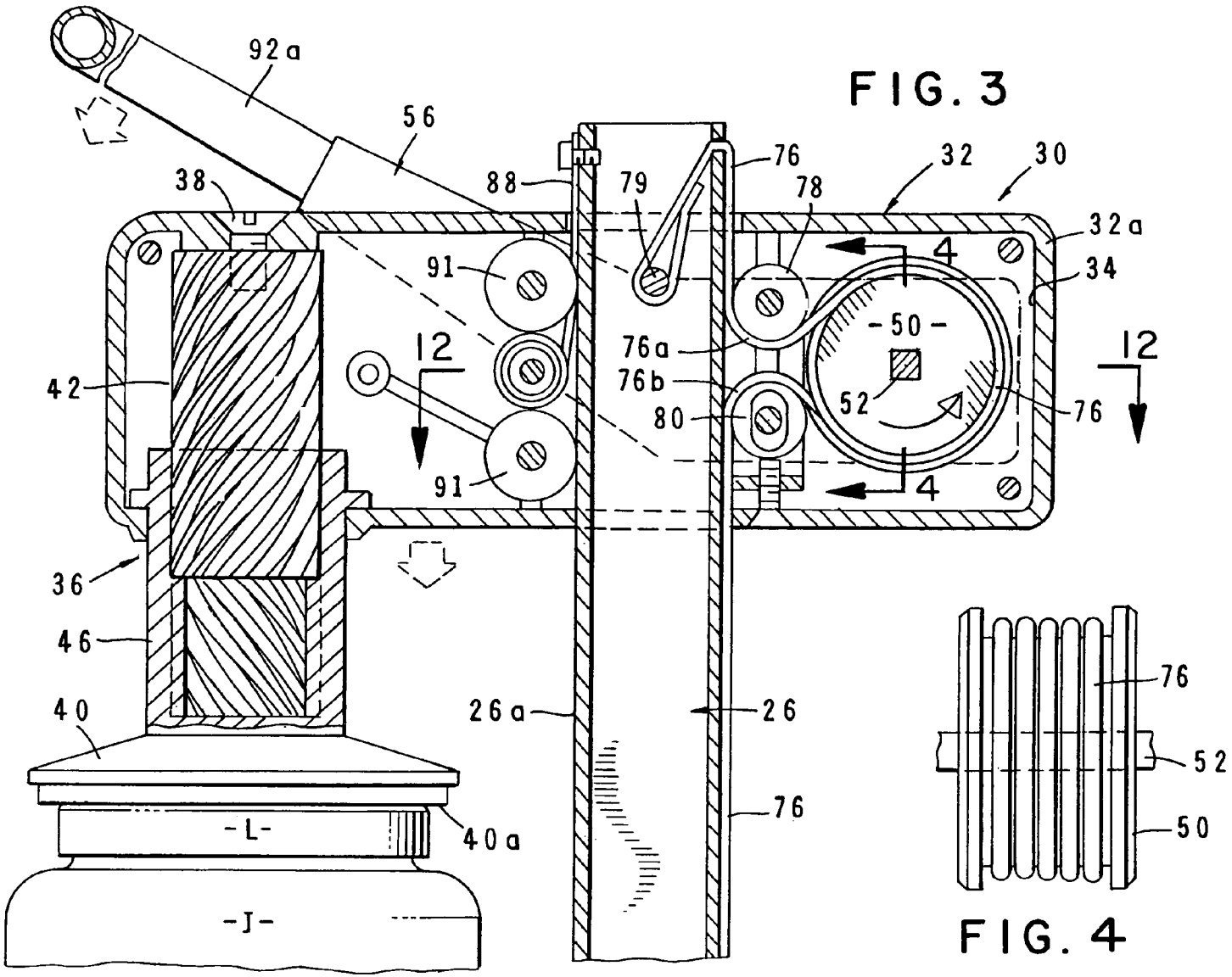
FIG. 3 is a cross-sectional view taken along lines 3—3 of FIG. 2.
FIG. 4 is an enlarged view taken along lines 4—4 of FIG. 3.

Referring to the drawings and particularly to FIGS. 1 in through 12, one form of the jar opener apparatus of the invention is there shown in generally designated by the numeral 20. As best seen in FIG. 1, the apparatus here comprises a base 22 having an elastomeric jar supporting and gripping surface 24. Connected to a base 22 is a generally vertically extending guide 26. As indicated, in FIGS. 2 and 3, guide 26 comprises a generally rectangular shaped, hollow tube having a roller engaging surface 26*a*. Connected to guide 26 for vertical movement relative thereto between a first position shown by the phantom lines in FIG. 1 and a second position shown by the solid lines in FIG. 1, is a carriage assembly generally designated by the numeral 30. Carriage assembly 30 comprises a carriage 32 which includes a hollow housing 32*a* having an interior space 34 (FIGS. 3 and 12) and a lid engaging assembly 36 which is connected to carriage 32 by means of a threaded connector 38 (FIG. 3). Lid engaging assembly 36 functions to frictionally engage the screw-on lid "L" of a jar "J" when the carriage is in the second position shown in FIG. 3. As best seen in FIG. 3, lid engaging assembly 36 here includes a lid engaging member 40 and rotating means for controllably rotating the lid engaging member. In the present form of the invention, this important rotating means comprises a helical drive screw 42, which is connected to carriage 32 and a helical driven tube 46, which is connected to lid engaging member 40 (FIG. 3). As will be discussed in greater detail hereinafter, as the carriage is moved into its lowered position by the operating means of the invention, the elastomeric gripping component 40*a* of the lid engaging member 40 will be brought into frictional contact with the screw-top lid of the jar and the helical drive screw 42 will then impart rotation to the helical driven tube 46 and to the lid engaging member so as to expeditiously loosen the lid.

Figure 12:
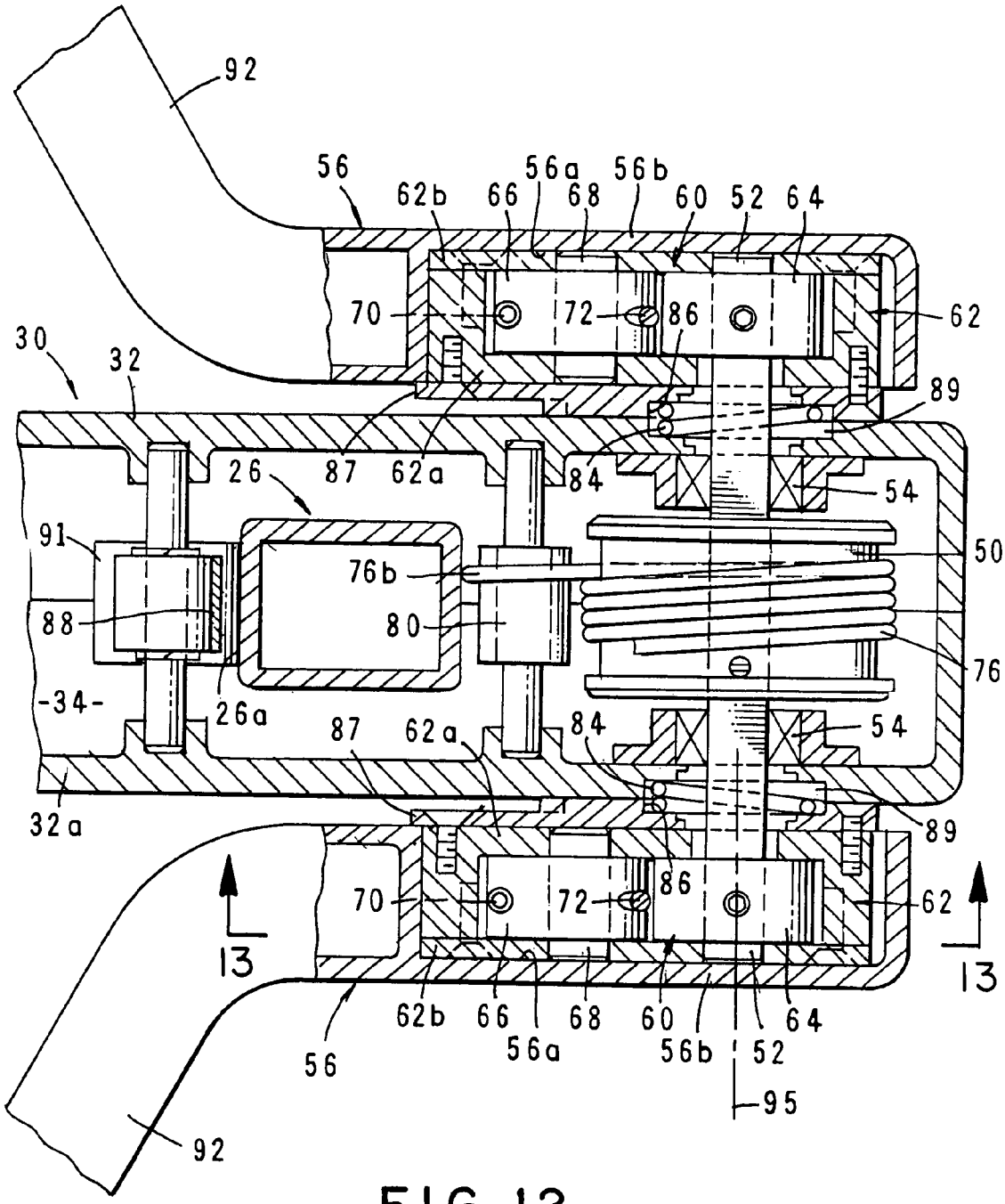
FIG. 12 is an enlarged cross sectional view taken along lines 12—12 of FIG. 3.
Figure 15:
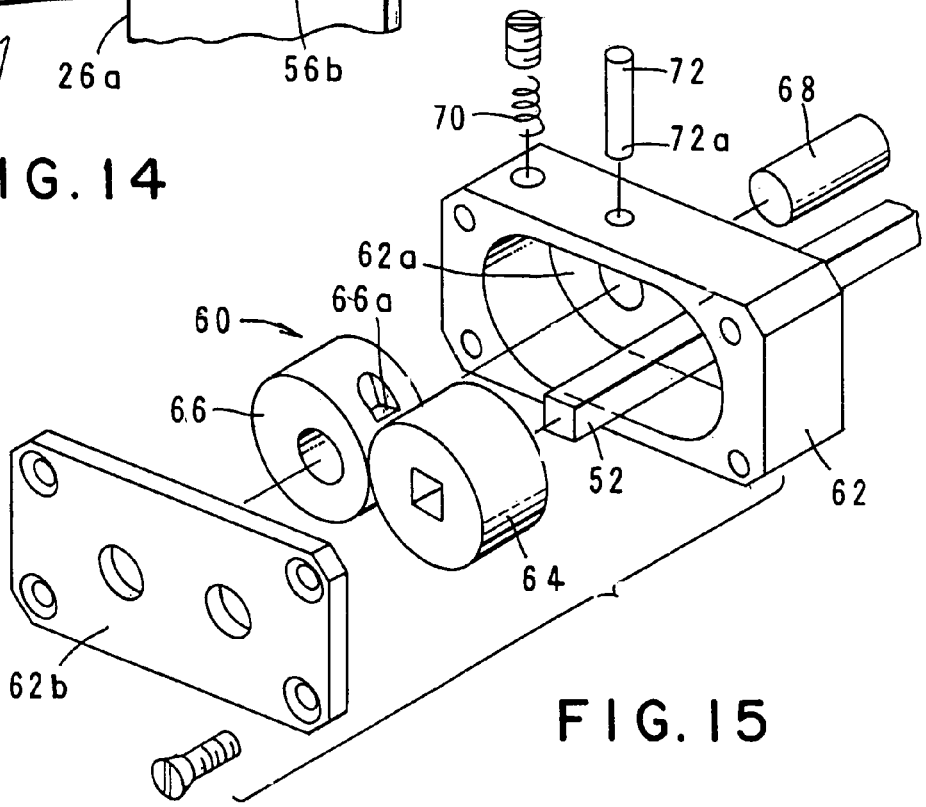
FIG. 15 is a generally perspective exploded view of one form of the drive assembly of the apparatus of the invention.

The important operating means of the invention, the character of which will next be described, is operably associated with carriage 32 and functions to controllably move the carriage between the first and second positions. In the present form of the invention, the operating means comprises a generally cylindrically shaped drum 50 which, in the manner shown in FIG. 12, is carried by carriage 32 for rotation therewithin. More particularly, as indicated in FIG. 3, drum 50 is connected to a generally rectangular shaped drive shaft 52 which is rotatably mounted within spaced-apart bearings 54 that are connected to the sidewalls 32*a* of carriage 32 (FIG. 12). Shaft 52 extends through bearings 54 and into cavities 56*a* formed in the spaced-apart sides 56*b* of a handle assembly 56 that also forms a part of the operating means of the invention. Housed within cavities 56*a* are the novel drum driving means of the invention which function to controllably rotate drum 50. As best seen by referring to FIGS. 12 and 15, the unique drum driving means of the invention comprises first and second identically configured drum drive assemblies which are generally designated in the drawings by the numeral 60. In the present form of the invention, each of these unique drum driving assemblies comprises a generally rectangularly shaped, hollow housing 62, a driven wheel 64 carried within the hollow housing and an eccentric driving wheel 66 carried within the housing at a location proximate the driven wheel 64. Driven wheel 64 is connected to driveshaft 52 for rotation therewith, while eccentric driving wheel 66 is rotatably mounted on a cylindrical shaft 68 which is supported by the sidewalls 62*a* and the cover components 62*b* of hollow housing 62 (see FIGS. 12 and 15).

Figure 14:
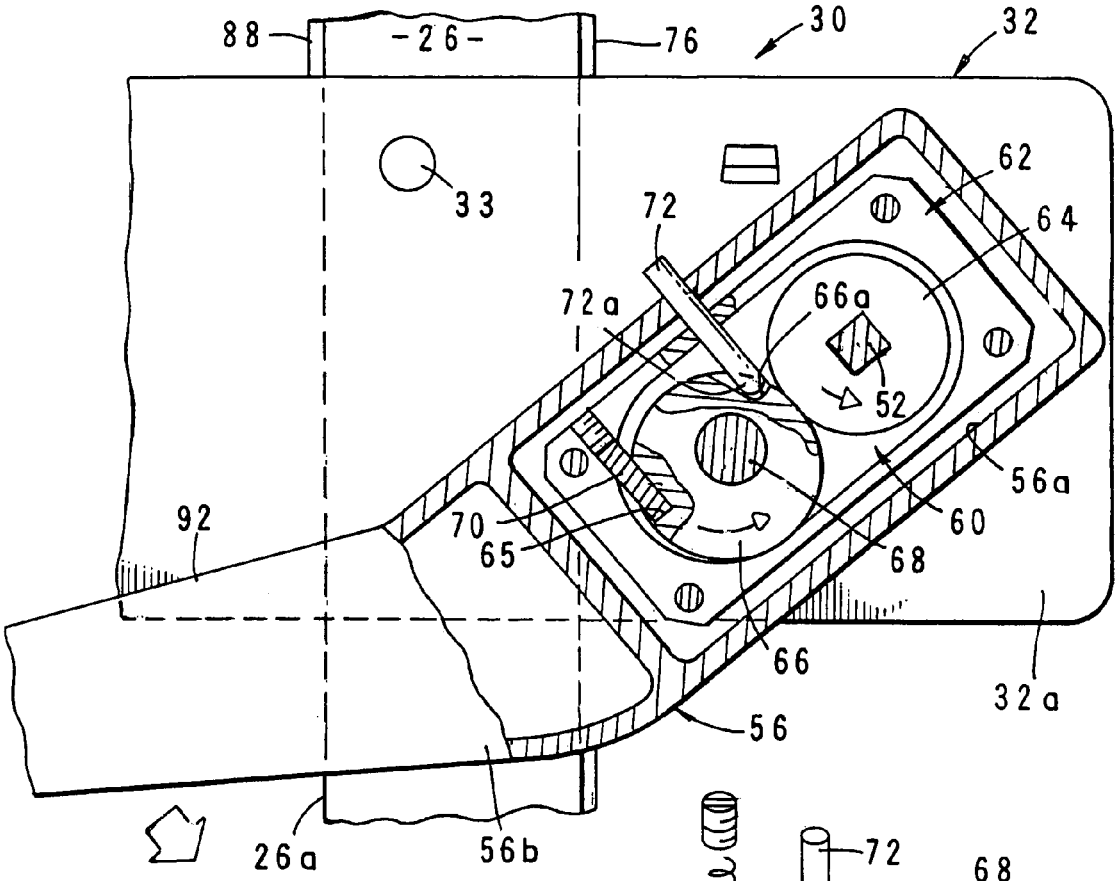
FIG. 14 is a side elevational, cross sectional view similar to FIG. 13 but showing the operating handle in a lower position.

In the manner illustrated in FIGS. 13 and 14, eccentric driving wheel 66 is movable between a first position shown in FIG. 13 wherein the periphery of the wheel is spaced-apart from the periphery of driven wheel 64, to a second position shown in FIG. 14 wherein the eccentric driving wheel has rotated into a position wherein the periphery of the wheel is in driving engagement with the periphery of driven wheel 64. As shown in these drawings, an eccentric driving wheel biasing means or coil spring 70, which is carried by hollow housing 62 engages a shoulder 65 formed on wheel 64 and continuously urges rotation of the eccentric driving wheel into the second position shown in FIG. 14. However, when the handle assembly 56 is in the first upraised position shown in FIG. 13, the inboard end 72*a* of a stop pin 72 engages a shoulder 66*a* formed on the eccentric wheel in a manner to prevent rotation of the eccentric wheel into the second position. Conversely, when the handle assembly 56 is initially moved toward its lowered position, the inboard end of the locking pin moves out of engagement with shoulder 66*a* thereby permitting the coil spring 70 to cause the eccentric wheel to rotate in a counter clockwise direction as viewed in FIG. 14 and into the position shown in FIG. 14. In this position, due to the unique eccentric configuration of the eccentric wheel, the wheel is in driving engagement with the periphery of the driven wheel 64 so that a continued downward movement of the handle assembly will result in rotation of the driven wheel along with the driveshaft 52. Rotation of driveshaft 52 by the driven wheel 64 will, of course, impart rotation to drum 50.

Also forming an important part of the operating means of the invention is an elongated cable 76 which is entrained around drum 50 in the manner shown in FIGS. 1, 3, 4 and 12. As best seen in FIGS. 1 and 3, the upper portion 76*a* of cable 76 is entrained under an idler wheel 78 and is then connected to a connecting pin 79 that is connected to guide column 26 proximate its upper end. Another portion 76*b* of the cable is entrained over an idler wheel 80 in the manner shown in FIG. 3 and the lower end 76*c* of the cable is connected to a connecting pin 81 that is connected to guide column 26 proximate its lower end. With this novel construction, as drum 50 is rotated, cable 76 will be wound around the drum thereby causing the carriage to move controllably downwardly. As the carriage moves downwardly, helical driveshaft 42 will cause helical tube 46 to rotate, which, in turn imparts rotational forces to lid engaging member 40. This rotational movement of the lid engaging member coupled with the downward pressure exerted on the lid will cause the threaded lid to expeditiously loosen.

Figure 9:
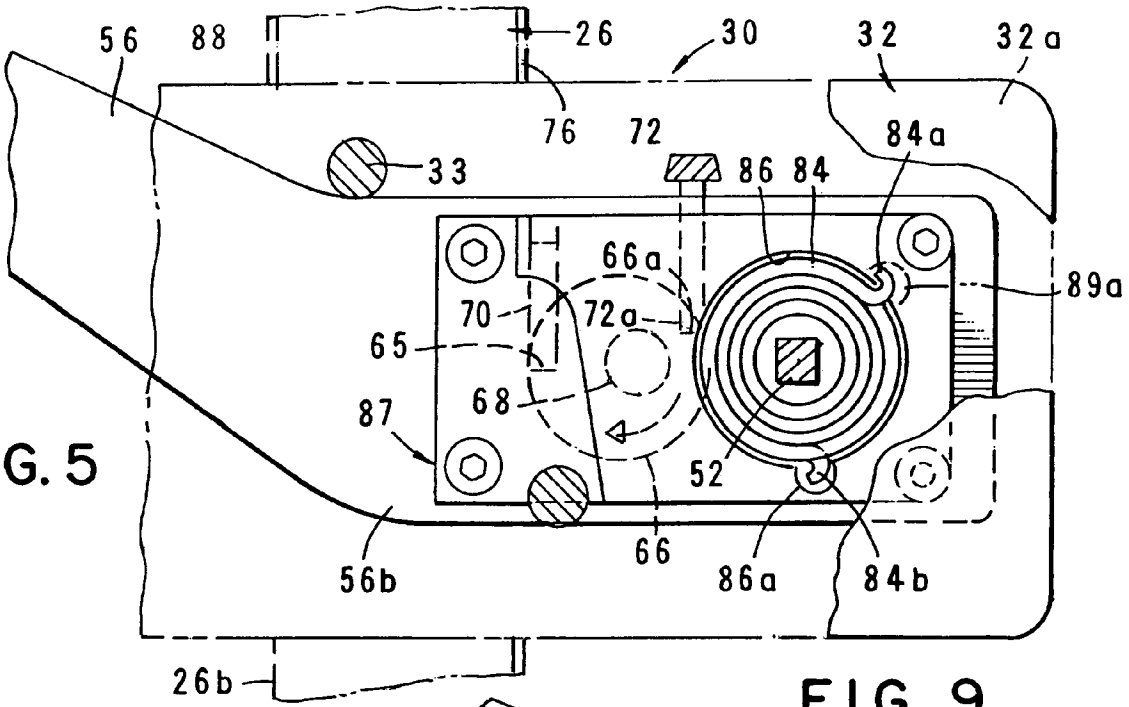
FIG. 9 is a cross-sectional view taken along lines 9—9 of FIG. 2.
Figure 10:
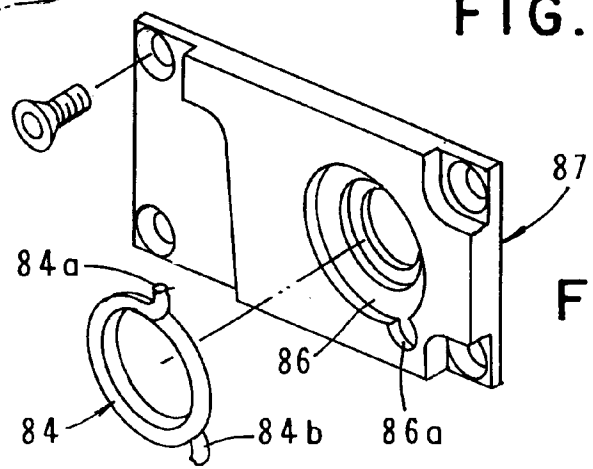
FIG. 10 is a generally perspective, exploded view of one of the torsion spring members and one of the cover members of the drive assembly housing of one form of the apparatus.
Figure 5:
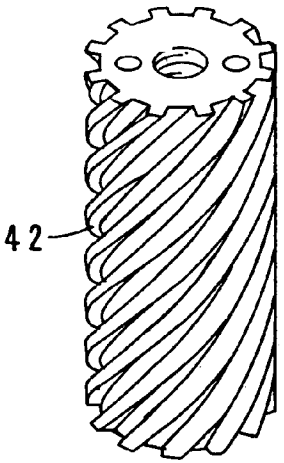
FIG. 5 is a generally perspective view of the helical drive shaft of the device.
Figure 6:
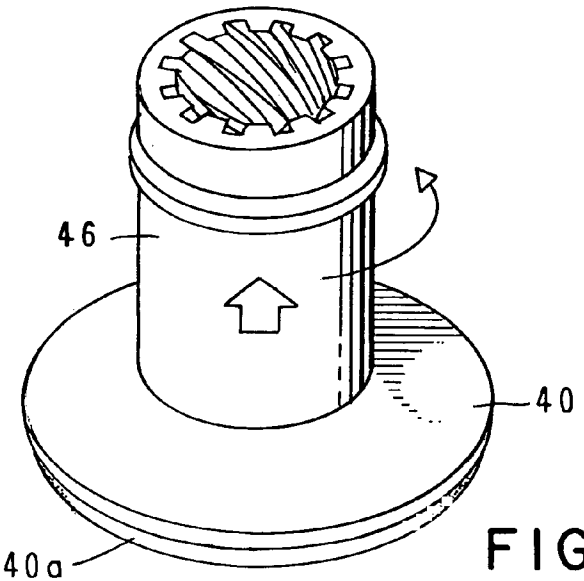
FIG. 6 is a generally perspective view of the helical driven tube and the jar lid engaging member of the device.
Figure 16:
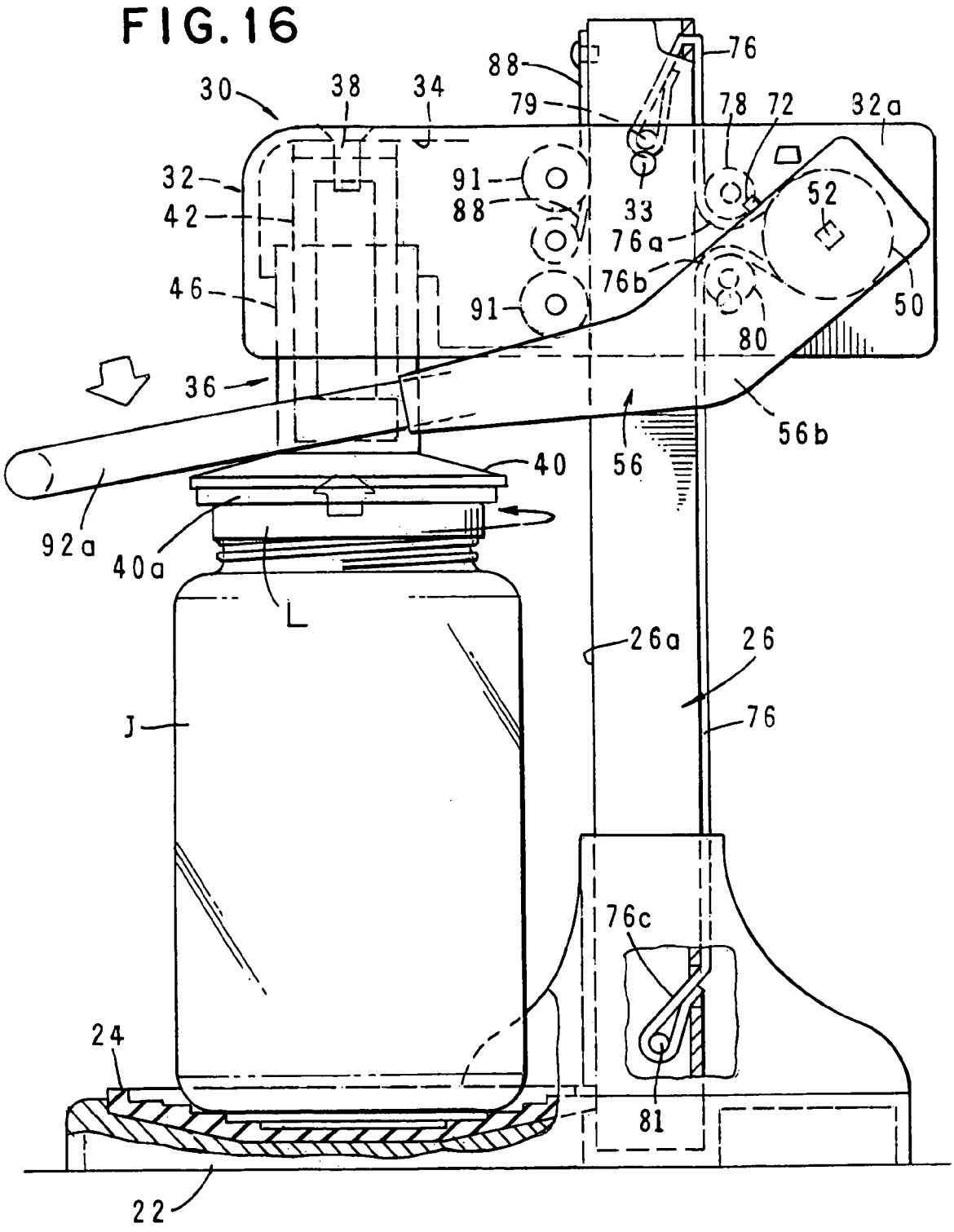
FIG. 16 is a side elevational view, partly in cross section similar to FIG. 1, but showing the operating handle in a lowered position.

Also forming a part of the operating means of the present form of the invention are handle assembly biasing means, here provided as torsion springs 84 that are carried within cavities 86 formed within side plates 87 that are connected to housings 62 (see FIGS. 9 and 10) and within cavities 89 formed in the side walls of carriage 30 (see FIG. 12). As shown in the drawings, each of the torsion springs 84 is provided with hook like end portions 84*a* hand 84*b* which are receivable within strategically located peripheral cavities 86*a* and 89*a*. With this construction, as the handle assembly 56 is moved toward its lower position, stresses will be formed in the torsion springs tending to cause the handle assembly to continuously return to its upper, starting position. Accordingly, when the handle assembly reaches its lowermost position shown in FIG. 16 and downward pressure on the handle assembly is released, springs 84 will cause the handle to automatically return to its upraised, starting position against stop member 33 (FIG. 9).

As the handle assembly moves upwardly, the eccentric driving wheels 66 will move into the position shown in FIG. 13 wherein the periphery of each of the driving wheels is spaced-apart from driven wheel 64. It is apparent from the foregoing discussion, that the eccentric wheels act as ratcheting mechanisms so that moving the handle assembly repeatably up-and-down repeatedly rotates the driven wheels 64 and, in turn, the drum 50 causing the cable to progressively wind about the drum. This resulting foreshortening of the cable causes a downward pressure to be exerted against the jar lid which is converted to a turning torque on the lid by the helical driveshaft 42, the helical drive tube 46 and the elastomeric friction material 40*a* carried by the lid engaging member. Downward pressure on the jar lid is limited by presetting the cable tension during the assembly of the unit to approximately 120 pounds. Beyond this cable tension, the cable will slip on the drum thereby preventing excessive pressure being exerted against the jar lid.

The operating means of the assembly also includes carriage biasing means here provided in the form of a spring 88 which is connected to guide 26 in the manner shown in FIG. 3. This carriage biasing means functions to yieldably resist movement of said carriage assembly from the first upraised position to the second lowered position and in so doing causes the carriage to move smoothly downwardly as the pair of carriage rollers 91 rollably engage the roller engaging surface 26*a* of guide column 26.

In using the apparatus of the invention and with the apparatus in the configuration shown by the phantom lines in FIG. 1, the jar to be opened which can be of various heights and diameters, is centered within the pad 24 that is carried by base 22 which accept jars of various diameters. Next, by gripping the bight portion 92*a* of the handle 92 of the handle assembly of the invention, the handle can be controllably pivoted downwardly about the axis 95 of shaft 52 (FIG. 12). As shown in FIG. 14, this downward movement of the handle assembly causes the end of stop pin 72 to move away from the shoulder 66*a* that is formed on eccentric driving wheel 66. Contemporaneously, spring 70 pushes against the shoulder 65 also formed on the eccentric driving wheel causing it to rotate in a counter clockwise direction as indicated by the arrows in FIG. 14. This counter clockwise rotation of the eccentric driving wheel causes its peripheral surface to quickly move into engagement with the peripheral surface of driven wheel 64 causing it to rotate and in so doing to impart rotation to drive shaft 52.

Turning to FIG. 3, it can be seen that rotation of drum 50 will cause the cable 76 to wind about the cable drum in a manner to foreshorten the cable and cause the carriage assembly to move downwardly into the position shown in FIG. 3. In this position, the elastomeric gripping portion 40*a* of jar lid engaging member 40 will be moved into secure frictional engagement with the jar lid. If desired, the carriage assembly can also be manually moved downwardly. A continued downward pressure exerted on handle 92 will cause helical driven shaft 42 to telescopically move into helical drive tube 46 and in so doing to impart rotation to the lid engaging member 40 causing the lid "L" to smoothly and effortlessly loosen.

As previously mentioned, the handle assembly is continuously biased to return to its raised starting position by the torsion springs 84. Accordingly, when the user discontinues the downward force on the handle assembly, the handle assembly will automatically return to its upraised position. As the handle returns to its upraised position, the eccentric drive wheel 66 will also return to its starting position as shown in FIG. 13 wherein its periphery is spaced-apart from the periphery of driven wheel 64. A subsequent downward force exerted on the handle 92 by the user will once again cause the eccentric drive wheel to move into driving engagement with the driven wheel 64 and impart rotation thereto. This novel relationship between the eccentric driving wheel and the driven wheel functions much like a conventional ratcheting type mechanism and enables the carriage assembly to be controllably, incrementally lowered relative to the jar to be opened through a pumping action exerted on the handle assembly. The mechanical advantage of the operating means of the invention provides sufficient loosening torque to be exerted against the jar lid to loosen even the most difficult jar lid assemblies.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention.

I claim:

1. A jar opener for opening a jar having a screw-on lid comprising:

(a) a base having a jar supporting surface;

(b) a generally vertically extending guide connected to said base;

(c) a carriage assembly operably associated with said guide for movement relative to said guide between a first position and a second position, said carriage assembly comprising;

(i) a carriage;

(ii) a lid engaging assembly connected to said carriage for engaging the screw-on lid when said carriage is in said second position, said lid engaging assembly including a lid engaging member and rotating mechanism operably associated with said lid engaging member for rotating said lid engaging member, said rotating mechanism comprising a drive screw connected to said carriage and a driven tube connected to said lid engaging member; and (d) operating means operably associated with said carriage for moving said carriage between said first and second positions.

2. The jar opener as defined in claim 1 in which said drive screw comprises a helical drive screw and in which said driven tube comprises a helical tube operably associated with said helical drive screw.

3. The jar opener as defined in claim 1 in which said carriage assembly further includes a pair of rollers in rollable engagement with said guide.

4. The jar opener as defined in claim 1 further including carriage biasing means connected to said guide for yieldably resisting movement of said carriage assembly from said first position to said second position.

5. The jar opener as defined in claim 1 in which said operating means includes a drum carried by said carriage for rotation therewithin.

6. The jar opener as defined in claim 5 in which said operating means further includes an elongated cable connected to said guide and entrained around said drum.

7. The jar opener as defined in claim 6 in which said operating means further includes a handle assembly connected to said carriage for movement between a first position and a second position.

8. The jar opener as defined in claim 7 in which said handle assembly includes drum driving means for controllably rotating said drum.

9. The jar opener as defined in claim 8 in which said drum driving means comprises a driveshaft connected to said drum and a driven wheel connected to said driveshaft.

10. The jar opener as defined in claim 9 in which said drum driving means further comprises an eccentric driving wheel movable between a first position spaced-apart from said driven wheel and a second position in driving engagement with said driven wheel.

11. The jar opener as defined in claim 10 in which said drum driving means further comprises a housing carried by said handle assembly for housing said eccentric driving wheel and said driven wheel.

12. The jar opener as defined in claim 11 further including handle assembly biasing means carried by said housing for yieldably resisting movement of said handle assembly from first position toward said second position.

13. The jar opener as defined in claim 11 in which said drum driving means further comprises eccentric driving wheel biasing means for urging said eccentric driving wheel toward said first position.

14. The jar opener as defined in claim 13 in which said drum driving means further comprises stop means carried by said housing for limiting rotational movement of said eccentric driving wheel.

15. A jar opener for opening a jar having a screw-on lid comprising:

(a) a base having a jar supporting surface;

(b) a generally vertically extending guide connected to said base;

(c) a carriage assembly connected to said guide for movement relative to said guide between a first position and a second position, said carriage assembly comprising;

(i) a carriage;

(ii) a lid engaging assembly connected to said carriage for engaging the screw-on lid when said carriage is in said second position, said lid engaging assembly including a lid engaging member and rotating mechanism operably associated with said lid engaging member for rotating said lid engaging member, said rotating mechanism comprising a helical drive screw connected to said carriage and a helical drive tube connected to said lid engaging member; and (d) operating mechanism operably associated with said carriage for moving said carriage between said first and second positions, said operating mechanism comprising:

(i) a drum carried by said carriage for rotation there within;

(ii) an elongated cable connected to said guide and entrained around said drum; and (iii) a handle assembly connected to said carriage for movement between a first position and a second position, said handle assembly including drum driving means for controllably rotating said drum.

16. The jar opener as defined in claim 15 in which said carriage assembly further includes a pair of rollers in rollable engagement with said guide.

17. The jar opener as defined in claim 15 in which said drum driving means comprises:

(a) a housing carried by said handle assembly;

(b) a driveshaft connected to said drum;

(c) a driven wheel carried within said housing and connected to said driveshaft;

(d) an eccentric driving wheel rotatably carried within said housing, said eccentric driving wheel being movable between a first position spaced-apart from said driven wheel and a second position in driving engagement with said driven wheel.

18. The jar opener as defined in claim 15 in which said drum driving means comprises:

(a) eccentric driving wheel biasing means for urging said eccentric driving wheel toward said first position; and (b) stop means carried by said housing for limiting rotational movement of said eccentric driving wheel.

19. The jar opener as defined in claim 17 further comprising handle assembly biasing means carried by said housing for yieldably resisting movement of said handle assembly from first position toward said second position.

20. A jar opener for opening a jar having a screw-on lid comprising:

(a) a base having a jar supporting surface;

(b) a generally vertically extending guide connected to said base;

(c) a carriage assembly connected to said guide for movement relative to said guide between a first raised position and a second lowered position, said carriage assembly comprising;

(i) a carriage;

(ii) a pair of rollers in rollable engagement with said guide;

(iii) a lid engaging assembly connected to said carriage for engaging the screw-on lid when said carriage is in said second position, said lid engaging assembly including a lid engaging member and rotating mechanism operably associated with said lid engaging member for controllably rotating said lid engaging member, said rotating mechanism comprising a helical drive screw connected to said carriage and a helical drive tube cooperatively connected to said lid engaging member; and (d) operating mechanism operably associated with said carriage for moving said carriage between said first and said second positions, said operating mechanism comprising:

(i) a drum carried by said carriage for rotation there within;

(ii) an elongated cable connected to said guide and entrained around said drum; and (iii) a handle assembly connected to said carriage for movement between a first position and a second position, said handle assembly including drum driving mechanism for controllably rotating said drum, said drum driving mechanism comprising:

a. a housing carried by said handle assembly;

b. a driveshaft connected to said drum;

c. a driven wheel carried within said housing and connected to said driveshaft; and d. an eccentric driving wheel carried within said housing, said eccentric driving wheel being movable between a first position spaced-apart from said driven wheel and a second position in driving engagement with said driven wheel.

* * * * *